United States Patent [19]

Nakanishi et al.

[11] 4,417,719

[45] Nov. 29, 1983

[54] TOP-AND-BOTTOM BLOWN CONVERTER

[75] Inventors: Kyoji Nakanishi; Tsutomu Nozaki; Toshihiko Emi, all of Chiba, Japan

[73] Assignee: Kawasaki Steel Corporation, Hyogo, Japan

[21] Appl. No.: 406,960

[22] Filed: Aug. 10, 1982

[51] Int. Cl.[3] ..... C21D 11/00

[52] U.S. Cl. ..... 266/78; 75/59; 75/60

[58] Field of Search ..... 75/59, 60; 266/78

[56] References Cited

U.S. PATENT DOCUMENTS

| | | | |
|---|---|---|---|
| 3,540,879 | 11/1970 | Carlson | 75/60 |
| 3,854,932 | 12/1974 | Bishop | 75/60 |
| 4,280,838 | 7/1981 | Marukawa | 75/52 |
| 4,302,244 | 11/1981 | Sieckman | 75/59 |

*Primary Examiner*—P. D. Rosenberg

*Attorney, Agent, or Firm*—Wenderoth, Lind & Ponack

[57] ABSTRACT

In a top-and-bottom blown converter having a plurality of tuyeres arranged at the bottom of converter housing, a monitoring sub-lance is vertically movable within a region defined between vertical planes passing through parallel lines horizontally spaced a distance of 300 mm from a tuyere aligning line.

8 Claims, 4 Drawing Figures

TOP-AND-BOTTOM BLOWN CONVERTER

BACKGROUND OF THE INVENTION

This invention relates to a top-and-bottom blown converter of the type wherein refining gases are blown into molten metal through a top-blowing lance inserted through a converter top opening and a plurality of tuyeres arranged at the bottom to refine the molten metal, and more particularly, to the position of a sub-lance directly immersed into the molten metal for measuring the temperature, carbon concentration and other factors of the molten metal during blowing.

As is well known in the steel making art, the blowing operation of a converter is conducted under controlled blowing conditions so that the desired carbon concentration and temperature of molten metal may be reached at the time of blowing-out. To this end, it has been a general practice to insert a sub-lance through a converter top opening during blowing to directly measure the carbon concentration and temperature of the molten metal by means of a probe at the lower tip of the sub-lance.

As a substitute for the conventional oxygen top-blown converter or LD converter, great attention has recently been paid to a bottom-blown converter of the type wherein refining gas is blown through tuyeres at the bottom. This process is also known as the quality basic oxygen process (Q-BOP). The bottom-blown converters have some advantages over the LD converters in that molten metal is more vigorously agitated with the gas blown through the bottom tuyeres to further reduce the concentration of iron value in the slag or the total iron in the slag (abbreviated as T.Fe), resulting in an improved iron yield. It is, however, expensive to replace the existing LD converters by bottom-blown converters. A compromise is to modify an existing LD converter by adding bottom blown tuyeres at the bottom thereof. Such a modified converter provides the advantage of bottom blowing without the sacrifice of the existing LD converter installation.

In the modified top-and-bottom blown converter, molten metal is vigorously agitated by the gas blown through the bottom tuyeres as in the genuine bottom-blown converter, causing the molten metal to vigorously wave or vibrate. When a sub-lance probe is inserted into such vigorously vibrating molten metal for the purpose of measuring the carbon concentration and temperature of the molten metal as described above, there is the likelihood that the probe will be broken or damaged to make measurement impossible. Particularly when gas is bottom blown at an increased flow rate, not only the probe, but also the sub-lance itself are broken or bent. The risk of steam explosion would result from ejection of coolng water circulating in the sub-lance and it becomes difficult to move the sub-lance vertically up and down. To overcome these problems, the inventors have made investigations of sub-lance failure to reach the following findings.

A group of bottom blowing tuyeres are often arranged in a top-and-bottom blown converter at intervals in alignment with a line which extends across the center of the converter bottom and runs parallel with a trunnion axis. The molten metal is waved such that opposite portions of the molten metal divided with respect to the line of alignment of the tuyeres will alternately move up and down as if mercury in a U-shaped tube moves alternately oppositely in a longitudinal direction of the tube under gravity. The wave becomes more vigorous as the distance from the line of alignment of the tuyeres becomes greater. Since commercially available top-and-bottom blown converters are obtained by modifying existing LD converters, the top lance for blowing a refining gas is usually designed so as to move in alignment with the vertical axis of the converter as in the case of LD converters. Thus, the monitoring sub-lance is generally moved vertically at a position spaced a distance of 1 m or more from the vertical axis of the converter. The monitoring sub-lance is immersed in a portion of the molten metal where waves are most severe. Consequently, the sub-lance undergoes severe impact from the molten metal and often experiences an accident of breakage or failure.

It is thus an object of this invention to minimize the impact force applied to a sub-lance probe and sleeve by molten metal, thereby preventing any accident of failure or bending of the sub-lance probe and sleeve.

SUMMARY OF THE INVENTION

According to this invention, a top-and-bottom blown converter of the above-mentioned type is designed such that the sub-lance is located where the wave of molten metal caused by the bottom blowing gas is minimum, that is, vertically above the line of alignment of the bottom blowing tuyeres or in proximity thereof, thereby minimizing the impact force applied to the sub-lance by the molten metal.

More specifically, a top-and-bottom converter comprising a converter housing having a vertical axis and a horizontal trunnion axis about which the housing is rotatable and provided with an opening at the top, the converter housing receiving molten metal therein. A plurality of tuyeres is arranged at the bottom of the converter housing in alignment with a line parallel to the trunnion axis for blowing a gas into the molten metal. A lance is inserted for vertical motion into the converter housing through the opening for blowing an oxidizing gas into the molten metal. A monitoring sub-lance is inserted for vertical motion into the converter housing through the opening such that its lower tip may be immersed in the molten metal for measurement. The feature of this invention resides in that the sub-lance is vertically movable within a region which is defined between vertical planes passing through parallel lines horizontally spaced a distance of 300 mm for the tuyere aligning line.

BRIEF DESCRIPTION OF THE DRAWINGS

The above and other objects, features and advantages of the present invention will be more fully understood by reading the following description in conjunction with the accompanying drawings, in which.

DESCRIPTION OF PREFERRED EMBODIMENTS

Figure 1:
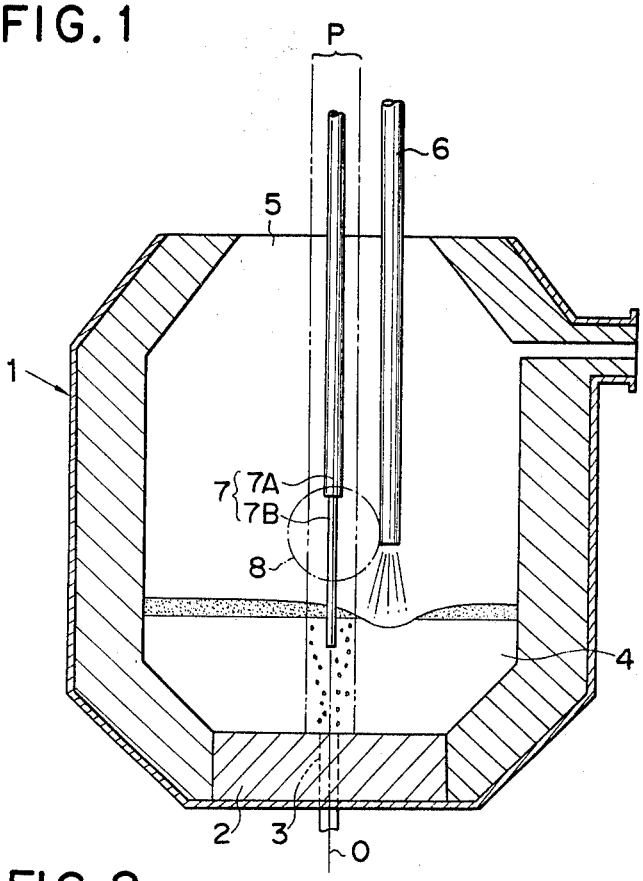
FIG. 1 is a schematic vertical cross section of one embodiment of the top-and-bottom blown converter according to the present invention, taken along line I—I in FIG. 2.
Figure 2:
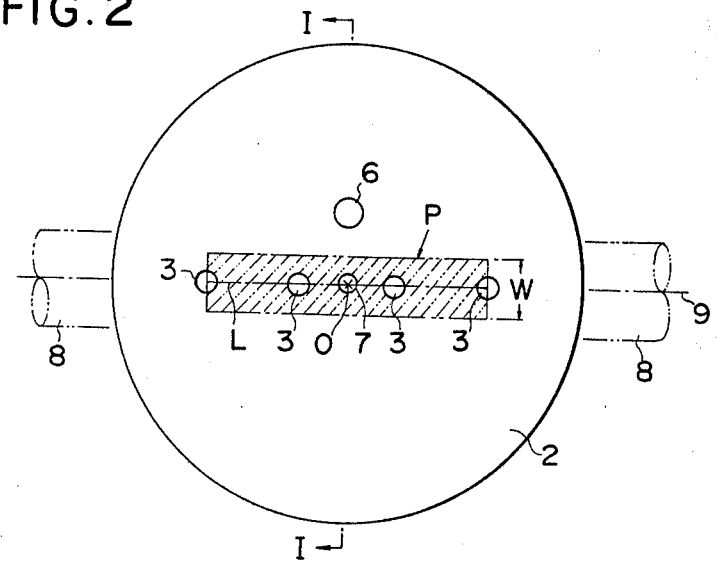
FIG. 2 is a schematic plan view showing the arrangement of the tuyeres, lance and sub-lance in the embodiment shown in FIG. 1.

Referring to FIGS. 1 and 2, the top-and-bottom blown converter of the present invention is shown as comprising a converter housing 1 consisting of a sheath lined with refractory brick and supported for rotation by means of horizontal trunnion shafts 8 having a common trunnion axis 9. The housing 1 has a vertical axis 0. A plurality of spaced-apart tuyeres 3 are aligned in a straight line L which is parallel to the trunnion axis 9. The line L is referred to as "tuyere-aligning line", hereinafter. The tuyere-aligning line L crosses the vertical axis 0 in the illustrated embodiment, but does not cross the vertical axis 0 in the embodiment shown in FIG. 4 as described later. An oxidizing gas, for example oxygen gas or inert gas, for example argon gas, is blown into molten metal 4 in the converter housing 1 through the tuyeres 3. In blowing an oxidizing gas, a double pipe structure tuyere consisting of outer and inner concentric pipes is used, and the oxidizing gas is fed through the inner pipe and a cooling gas such as a hydrocarbon gas is fed through the path between the outer and inner pipes to cool the tuyere nozzle. In blowing an inert gas only, a single pipe structure may generally be employed. The converter housing 1 is provided at the top with an opening 5 through which a top-blowing lance 6 is inserted for vertical motion into the converter housing for blowing an oxidizing gas into the molten metal from above. A monitoring sub-lance 7 is also inserted for vertical motion into the converter housing 1 through the opening 5 for the purpose of measuring the carbon concentration and temperature of the molten metal. The sub-lance 7 comprises a tubular sleeve 7A having an interior fluid circuit for coolant circulation (not shown) and a probe 7B detachably mounted to the lower end of the sleeve 7A. The sub-lance 7 is designed such that the temperature or carbon concentration of the molten metal may be measured by immersing the probe 7B in the molten metal 4. If desired, the level or oxygen concentration of the molten metal or slag level may be similarly measured. The sub-lance 7 is located for vertical motion in alignment with the tuyere-aligning line L, and particularly in FIG. 2, in alignment with the vertial axis 0. On the other hand, the top-blowing lance 6 is parallel to and spaced apart by a distance of more than 300 mm from the vertical axis 0.

In the embodiment shown in FIGS. 1 and 2, the molten metal 4 is vigorously agitated with the bottom blowing gas during a blowing operation so that the metal bath has waves. Waving is a minimum above the tuyere-aligning line L because of the interference between the waves on the opposite sides with respect to the tuyere-aligning line L. Minimum impact is then applied to the sub-lance 7, and the risk of failure or breakage of the probe 7B or bending or failure of the sleeve 7A is minimized.

Since the disturbance of the metal is minimum not only at the crossing of the metal surface with a vertical projection of the tuyere-aligning line L, but also in proximity of the crossing, the sub-lance 7 may also be located in proximity of a vertical projection of the tuyere-aligning line L. Using a commonly used converter having a capacity of 80 to 350 tons of molten metal per charge, the inventors made a series of blowing experiments to determine that an effective arrangement provides a region P defined between vertical planes passing through parallel lines spaced a distance of 300 mm from the tuyere-aligning line L, that is a space defined by vertically projecting a band having a total width W of 600 mm with the center at the tuyere-aligning line L and a length between the outermost tuyeres. When the sub-lance 7 is vertically moved within the above-defined region P to immerse its probe into the molten metal 4, the occurrence of sub-lance failure is considerably minimized as compared with the case wherein the sub-lance is moved outside the above-defined region P. In an experiment, a 250-ton and top-and-bottom blown converter was used and six tuyeres having an inner diameter of 30 mm were arranged at equal intervals at the bottom in alignment with the line L as shown in FIG. 2. The top-blowing lance was spaced at a distance of 800 mm from the vertical axis 0 as shown in FIG. 2. Oxygen was blown into the melt through the lance and the tuyeres at a top-blowing flow rate of 2 $Nm^3$/min.t and a bottom-blowing flow rate of 0.5 $Nm^3$/min.t. The monitoring sub-lance was located at three different positions:

(A) a position on the tuyere-aligning line L (more accurately, the position of vertical axis 0 of the converter), (B) a position on the confines of the above-defined region P spaced at a distance of 300 mm from the tuyere-aligning line L, and (C) a position outside the above-defined region P.

At each of these different positions, the sub-lance was operated for a number of runs. The occurrence of sub-lance failure or damage (when sub-lance measurement became impossible) is shown in Table 1.

TABLE 1

| Sub-lance position | Occurrence of sub-lance failure |
|---|---|
| A | 0.1% |
| B | 0.8% |
| C | 5.7% |

As seen from Table 1, sub-lance failure occurs at substantially less probability when the sub-lance is located within the region P extending from the central tuyere-aligning line to the confines thereof than when the sub-lance is located outside the region P.

Accordingly, an important feature of the present invention is that the sub-lance 7 is movable within the specified region P including the tuyere-aligning line L.

Figure 3:
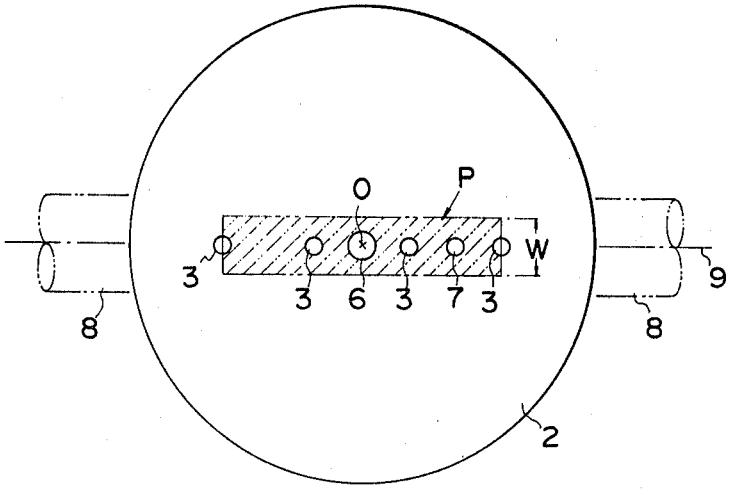
FIG. 3 is a schematic plan view showing the arrangement of the tuyeres, lance and sub-lance in another embodiment of the present invention.

In the first embodiment shown in FIGS. 1 and 2, a plurality of tuyeres are aligned with a line crossing the vertical axis of the converter and parallel to the trunnion axis, and a top-blowing lance is located for vertical motion at a position spaced apart from the vertical axis. It is also possible to locate the top-blowing lance for vertical motion at the vertical axis while the tuyeres are similarly aligned. In a second embodiment shown in FIG. 3, a plurality of tuyeres 3 are aligned with a line L crossing the vertical axis 0 of the converter and parallel to the trunnion axis, the lance 6 is aligned with the vertical axis 0, and the sub-lance 7 is vertically movable within a region P, which is defined between vertical planes passing through parallel lines horizontally spaced a distance of 300 mm from the aligning line L, and is spaced a substantial distance from the vertical axis 0.

Figure 4:
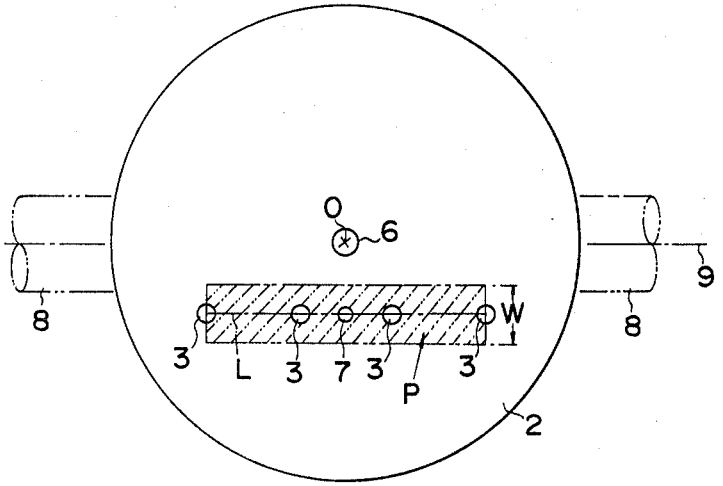
FIG. 4 is a schematic plan view showing the arrangement of the tuyeres, lance and sub-lance in a further embodiment of the present invention.

FIG. 4 shows a third embodiment of the converter according to the present invention wherein a plurality of tuyeres 3 are aligned with a line L which is parallel to the trunnion axis 9, but spaced apart from the vertical axis 0 for the purpose of preventing the tuyeres from being exposed to the atmosphere when the converter housing is tilted in one direction for charging and discharging. As in the first embodiment, the sub-lance 7 is movable within a region P defined between vertical planes passing through parallel lines spaced a distance of 300 mm from the tuyere-aligning line L. On the other hand, the top-blowing lance 6 may be aligned with the vertical axis 0 of the converter housing. Since the waves in the metal bath are at a minimum at the region P as in the first embodiment, this embodiment is also effective in preventing the failure of the sub-lance 7.

As understood from the foregoing, in the top-and-bottom blown converter according to the present invention, minimum impact force is applied by a metal bath to the sub-lance which is to be immersed in the metal bath for the measurement of the carbon concentration, temperature or other factors of the bath. Hence, the failure or breakage of the sub-lance or sub-lance probe is prevented, thus eliminating the problems such as that the carbon content cannot be measured, that the sub-lance cannot be vertically moved because of bending, and that coolant is ejected to give rise to steam explosion because of sub-lance failure.

We claim:

1. A top-and-bottom blown converter comprising:

a converter housing having a vertical axis and a horizontal trunnion axis about which the housing is rotatable and provided with an opening at the top, said converter housing receiving molten metal therein;

a plurality of tuyeres arranged at the bottom of said converter housing and aligned in a line extending parallel to said trunnion axis for blowing a gas into said molten metal;

a lance mounted for vertical motion into said converter housing through said opening for blowing an oxidizing gas into said molten metal; and a monitoring sub-lance mounted for vertical movement into said converter housing through said opening such that a lower tip of said sub-lance may be immersed in said molten metal for measurement, said sub-lance being mounted for said vertical movement within a region defined between two vertical planes passing through two parallel lines each horizontally spaced by a distance of 300 mm from said tuyere aligning line.

2. A top-and-bottom blown converter as claimed in claim 1, wherein said tuyere aligning line crosses said vertical axis.

3. A top-and-bottom blown converter as claimed in claim 2, wherein said top-blowing lance is movable in alignment with said vertical axis, and said monitoring sub-lance is spaced from said vertical axis.

4. A top-and-bottom blown converter as claimed in claim 2, wherein said top-blowing lance is spaced from said vertical axis.

5. A top-and-bottom blown converter as claimed in claim 1, wherein said tuyere aligning line is spaced from said vertical axis.

6. A top-and-bottom blown converter as claimed in claim 5, wherein said top-blowing lance is movable in alignment with said vertical axis.

7. A top-and-bottom blown converter as claimed in claim 1, wherein said converter housing has a capacity of 80 to 350 tons of molten metal per charge.

8. A top-and-bottom blown converter as claimed in claim 1, wherein said monitoring sub-lance is designed to measure at least one of the temperature, level and carbon and oxygen concentrations of said molten metal, and slag height.

* * * * *